US011499344B2

(12) United States Patent
Jean et al.

(10) Patent No.: US 11,499,344 B2
(45) Date of Patent: Nov. 15, 2022

(54) MAGNETIC-ACTUATION LATCH DEVICE

(71) Applicant: Wen-Fong Jean, Taoyuan (TW)

(72) Inventors: Wen-Fong Jean, Taoyuan (TW); Tai-Lien Huang, Taoyuan (TW); Sen-Hung Chen, Taoyuan (TW)

(73) Assignee: Wen-Fong Jean, Taoyuan (TW)

( * ) Notice: Subject to any disclaimer, the term of this patent is extended or adjusted under 35 U.S.C. 154(b) by 165 days.

(21) Appl. No.: 17/164,169

(22) Filed: Feb. 1, 2021

(65) Prior Publication Data

US 2021/0317685 A1 Oct. 14, 2021

(30) Foreign Application Priority Data

Apr. 10, 2020 (TW) ..... 109112094

(51) Int. Cl.
*E05B 47/00* (2006.01)
*E05B 63/08* (2006.01)
(Continued)

(52) U.S. Cl.
CPC ..... *E05B 47/0046* (2013.01); *E05B 63/08* (2013.01); *E05C 1/002* (2013.01); *E05C 1/085* (2013.01)

(58) Field of Classification Search
CPC .... Y10T 292/11; E05B 47/0046; E05B 63/08; E05B 15/10; E05B 47/0038;
(Continued)

(56) References Cited

U.S. PATENT DOCUMENTS

2003/0033839 A1* 2/2003 Chen ..... E05B 15/02 70/107
2014/0265362 A1* 9/2014 Chang ..... E05C 19/163 292/175
(Continued)

FOREIGN PATENT DOCUMENTS

CN 102606003 A * 7/2012 ..... E05B 15/024
CN 105952274 A * 9/2016 ..... E05B 15/024
(Continued)

OTHER PUBLICATIONS

DE 202018104402 Oct. 29, 2018 with ESPACENET machine translation Sep. 2022 (Year: 2018).*

*Primary Examiner* — Kristina R Fulton
*Assistant Examiner* — Steven A Tullia
(74) *Attorney, Agent, or Firm* — Kirton McConkie; Evan R. Witt

(57) ABSTRACT

The disclosure relates to a magnetic-actuation latch device. The magnetic-actuation latch device includes a housing, a latch element, a sliding plate, an elastic component, a rotating element and a limitation element. A lateral opening of the housing spatially corresponds a first magnetic block mounted on a fixed component. When a second magnetic block of the latch element is aligned to the first magnetic block, an actuation force is generated to drive the latch element to pass through the lateral opening and engage with the fixed component. The elastic component is connected between the sliding plate and the housing. When the rotating element is rotated by an external force, the sliding plate is driven to misalign the second magnetic block from the first magnetic block, and the latch element does not pass through the lateral opening. The limitation element is pivotally connected to the housing for blocking the rotating element.

20 Claims, 13 Drawing Sheets

(51) Int. Cl.
*E05C 1/08* (2006.01)
*E05C 1/00* (2006.01)

(58) Field of Classification Search
CPC ..... E05B 47/004; E05C 1/002; E05C 19/163; E05C 19/16; E05C 1/00; E05C 1/004; E05C 1/08; E05C 1/12
See application file for complete search history.

(56) References Cited

U.S. PATENT DOCUMENTS

| | | | | |
|---|---|---|---|---|
| 2014/0319850 | A1* | 10/2014 | Berger | E05C 19/163 292/177 |
| 2016/0305161 | A1* | 10/2016 | McMahon | E05B 59/00 |
| 2017/0138087 | A1* | 5/2017 | Chen | E05B 59/00 |
| 2020/0208437 | A1* | 7/2020 | Cheng | E05B 47/004 |

FOREIGN PATENT DOCUMENTS

| | | | | |
|---|---|---|---|---|
| DE | 202009008644 | U1 * | 12/2010 | E05B 47/0046 |
| DE | 102013101294 | A1 * | 8/2014 | E05B 17/0058 |
| DE | 202014105350 | U1 * | 3/2015 | E05B 13/005 |
| DE | 202015101504 | U1 * | 8/2016 | E05B 47/0004 |
| DE | 202018104402 | U1 * | 12/2018 | |
| DE | 202019100117 | U1 * | 2/2019 | |
| DE | 202019100274 | U1 * | 3/2019 | |
| EP | 1580361 | A1 * | 9/2005 | E05B 55/12 |
| EP | 2468988 | A2 * | 6/2012 | E05B 63/0056 |
| EP | 3101205 | A1 * | 12/2016 | E05B 47/0038 |
| EP | 3597843 | A1 * | 1/2020 | E05B 47/00 |
| GB | 2440025 | A * | 1/2008 | E05B 47/004 |
| GB | 2525436 | A * | 10/2015 | E05B 13/005 |
| KR | 100389060 | B1 * | 7/2000 | E05B 13/005 |
| KR | 100945694 | B1 * | 8/2009 | E05B 9/08 |
| KR | 20140088729 | A * | 1/2013 | E05B 47/0046 |
| KR | 101764871 | B1 * | 12/2016 | E05B 47/0004 |

* cited by examiner

MAGNETIC-ACTUATION LATCH DEVICE

FIELD OF THE INVENTION

The present disclosure relates to a latch device, and more particularly to a thinned magnetic-actuation latch device capable of being embedded in a door.

BACKGROUND OF THE INVENTION

Doors, windows, or furniture in human life often has a set of components, which need to be opened or closed with each other. In addition to maintaining the function of opening and closing, the components also need to be locked by a latch device.

With the changes in application requirements, the door latch device gradually tends to be light, thin, short and small in design. However, a conventional latch device applied to the door includes many components to provide the necessary function of opening and closing and the function of locking. Moreover, the opening, closing and locking operations for the door body are achieved through the operation of the user. For certain latch devices used in special environments, for example, the latch device applied to the door on a transportation vehicle, it further needs to provide the requirement of closing the door automatically.

Furthermore, in order to increase the application range of the latch device, a latch device combined with the magnetic force is provided on the market. However, when the latch device for the door body is combined with the magnetic component, the total number of components and the overall volume of the latch device are increased. The cost of production and assembly and the required installation space are also increased. It fails to thin the entire structure effectively and achieve a simplified appearance in design. It cannot meet the actual application requirements for being embedded in the door.

Therefore, it is necessary to provide a thinned magnetic-actuation latch device capable of being embedded in a door to solve the foregoing problems and overcome the above drawbacks.

SUMMARY OF THE INVENTION

An object of the present disclosure is to provide a thinned magnetic-actuation latch device capable of being embedded in a door. With the components arranged in a flat housing, it facilitates the magnetic-actuation latch device to be embedded in the applied door body and meets the requirement of thinning. Moreover, by utilizing the actuation force between the magnetic blocks of the magnetic-actuation latch device, it is helpful for achieving the purpose of closing the door automatically. The entire structure of the magnetic-actuation latch device is compact. The overall structure is compact. It is easy to assemble, maintain and operate.

Another object of the present disclosure is to provide a thinned magnetic-actuation latch device capable of being embedded in a door. The magnetic-actuation latch device has a compacted-and-thinned structure, and can be assembled easily. The sliding plate is controlled to slide relative to the housing by the guiding slot disposed in the center and the elastic component connected on both sides. In addition to meeting the requirements of thinned design, it is also conducive to improving the sliding stability of the sliding plate relative to the housing. Furthermore, a guiding pillar and a guiding groove are disposed correspondingly between the sliding plate and the housing. It is helpful for enhancing the sliding stability of the sliding plate relative to the housing.

A further object of the present disclosure is to provide a thinned magnetic-actuation latch device capable of being embedded in a door. Compared with the conventional tenon structure, the magnetic-actuation latch device further provides the functions of automatically aligning and closing the door body by utilizing the actuation force between the magnetic blocks. Combined with the thinned design, the components of the magnetic-actuation latch device are arranged in a flat housing. It is easier to assemble, replace or maintain. The competitiveness of the magnetic-actuation latch device is improved effectively.

According to an aspect of the present disclosure, there is a magnetic-actuation latch device for being disposed on a door body. The door body includes a movable component and a fixed component, the movable component includes an installation slot. The fixed component includes a first magnetic block. The magnetic-actuation latch device includes a housing, a latch element, a sliding plate, an elastic component, a rotating element and a limitation element. The housing is configured to be embedded in the installation slot of the movable component. The housing includes an accommodation seat and a lateral opening, the lateral opening is communication with the accommodation seat, and the lateral opening spatially corresponds to the first magnetic block. The latch element spatially corresponds to the lateral opening and includes a second magnetic block. When the second magnetic block is aligned to the first magnetic block, an actuation force is generated to drive the latch element to pass through the lateral opening, and the latch element is exposed from the lateral opening and engaged with the fixed component, so that the movable component and the fixed component of the door body are operated in a closed state. The sliding plate is received in the accommodation seat and connected to the latch element. The sliding plate includes two connection ends, a guiding slot and a guiding portion. The guiding slot spatially corresponds to the latch element and the lateral opening. The guiding portion is disposed adjacent to the guiding slot, and the guiding slot is located between the two connection ends. The elastic component is connected to the two connection ends of the sliding plate and the housing and configured to provide an elastic force to drive the sliding plate and the latch element to move away from the lateral opening. The actuation force is greater than the elastic force. The rotating element is pivotally connected to the housing and located in the guiding slot of the sliding plate. The rotating element includes an abutting end and a limited end disposed on the periphery of the rotating element, respectively. When the rotating element is rotated by an external force, the abutting end is engaged with the guiding portion to resist the actuation force and drives the guiding slot of the sliding plate to slide relative to the rotating element, the second magnetic block of the latch element is separated from the first magnetic block, and the latch element is free of passing through the lateral opening. When the second magnetic block and the first magnetic block are misaligned, the elastic force drives the sliding plate and the latch element to keep the latch element free of passing through the lateral opening. The limitation element is pivotally connected to the housing and includes a limitation portion spatially corresponding to the limited end of the rotating element, wherein when the limitation portion of the limitation element is rotated to be aligned to and engaged with the limited end, the rotating element is blocked.

In an embodiment, when the limitation portion of the limitation element is rotated to be misaligned to and separated from the limited end, the rotating element is rotatable.

In an embodiment, the magnetic-actuation latch device further includes a stopper disposed on a mounting slot of the fixed component and spatially corresponding to the latch element. The first magnetic block is embedded in an engaging slot of the stopper. When the second magnetic block is aligned to the first magnetic block, the latch element is driven to pass through the lateral opening, the latch element and the engaging slot of the stopper are engaged with each other, and the movable component is restricted from moving relative to the fixed component, so that the movable component and the fixed component of the door body are operated in a closed state.

In an embodiment, the magnetic-actuation latch device further includes an auxiliary elastic element disposed between the rotating element and the housing, and configured to provide a restoring force to rotate the abutting end to an initial position.

In an embodiment, the auxiliary elastic element is a torsion spring.

In an embodiment, the housing includes a first limiting pillar spatially corresponding to the abutting end of the rotating element. When the rotating element is subjected to the restoring force of the auxiliary elastic element, the first limiting pillar is configured to restrict the abutting end at the initial position.

In an embodiment, the housing includes a second limiting pillar spatially corresponding to the limitation portion of the limitation element and configured to restrict the limitation portion, so as to facilitate the limitation portion to align to and engage with the limited end.

In an embodiment, the sliding plate includes at least one guiding pillar, and the housing includes at least one guiding groove. The guiding pillar is received in the guiding groove and configured to guide a sliding direction of the sliding plate relative to the housing.

In an embodiment, the magnetic-actuation latch device further includes a handle and a first rotating shaft passing through the rotating element and at least partially exposed to the housing. The handle covers the first rotating shaft, and is exposed from the movable component and configured to be forced to rotate the rotating element.

In an embodiment, the magnetic-actuation latch device further includes a locking knob and a second rotating shaft passing through the limitation element and at least partially exposed to the housing, wherein the locking knob covers the second rotating shaft, and is exposed from the movable component and configured to rotate the limitation element.

In an embodiment, the elastic component includes two tension springs. First ends of the two tension springs are connected to the two connection ends of the sliding plate, respectively, and second ends of the two tension springs are connected to the housing, respectively. The guiding slot of the sliding plate is located between the two tension springs.

In an embodiment, the latch element and the sliding plate are connected through a pair of collars and a pair of protrusions matched and engaged with each other.

In an embodiment, the latch element includes an accommodation slot configured to accommodate the second magnetic block, wherein the accommodation slot has an opening facing to the sliding plate.

In an embodiment, the housing includes an upper cover.

The above objects and advantages of the present disclosure become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only; it is not intended to be exhaustive or to be limited to the precise form disclosed.

Figure 1:
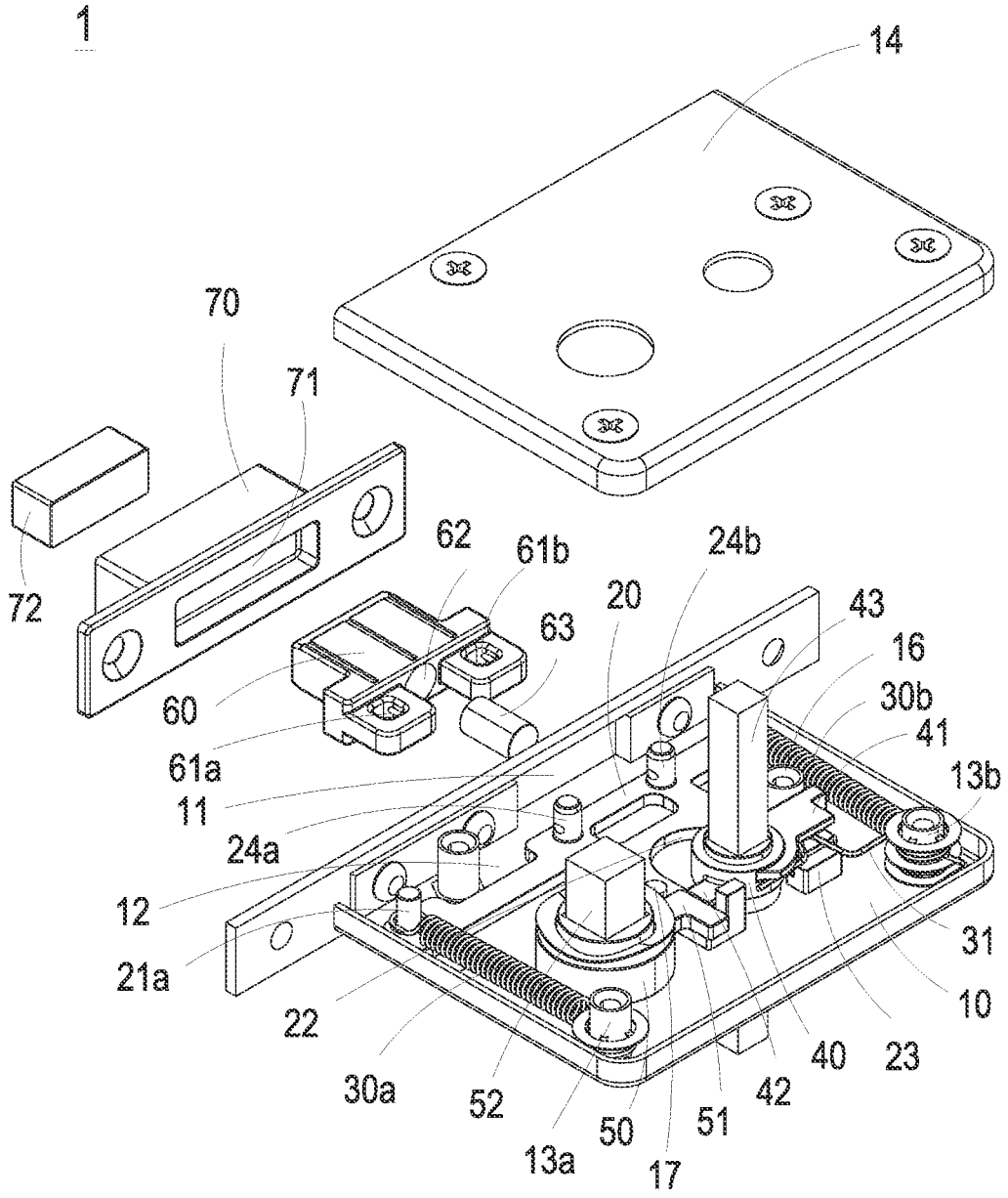
FIG. 1 is an exploded view illustrating a magnetic-actuation latch device according to an embodiment of the present disclosure.
Figure 2:
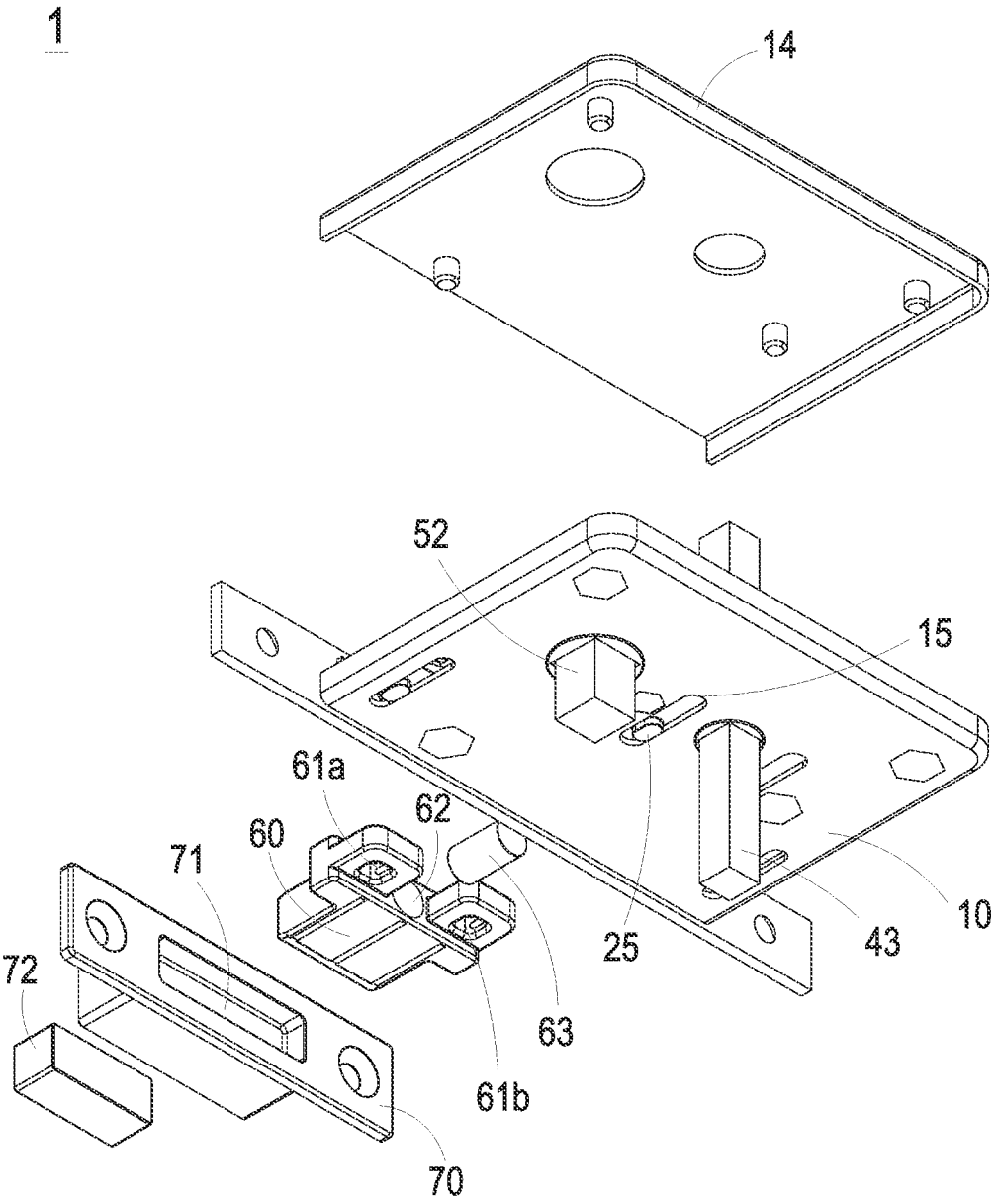
FIG. 2 is an exploded view illustrating the magnetic-actuation latch device according to the embodiment of the present disclosure and taken from another perspective.
Figure 3:
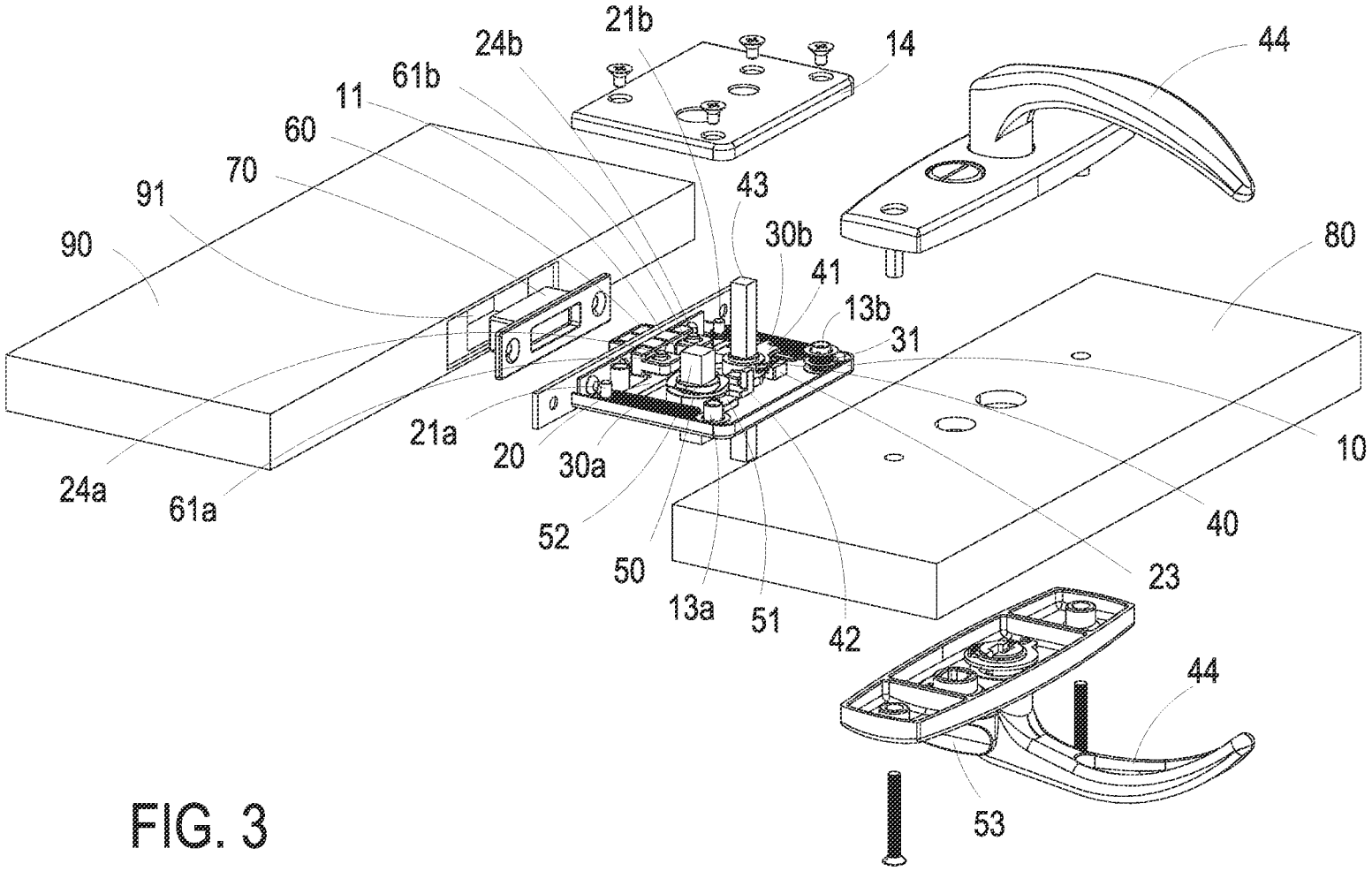
FIG. 3 is an exploded view illustrating the magnetic-actuation latch device disposed on a door body according to the embodiment of the present disclosure.
Figure 4:
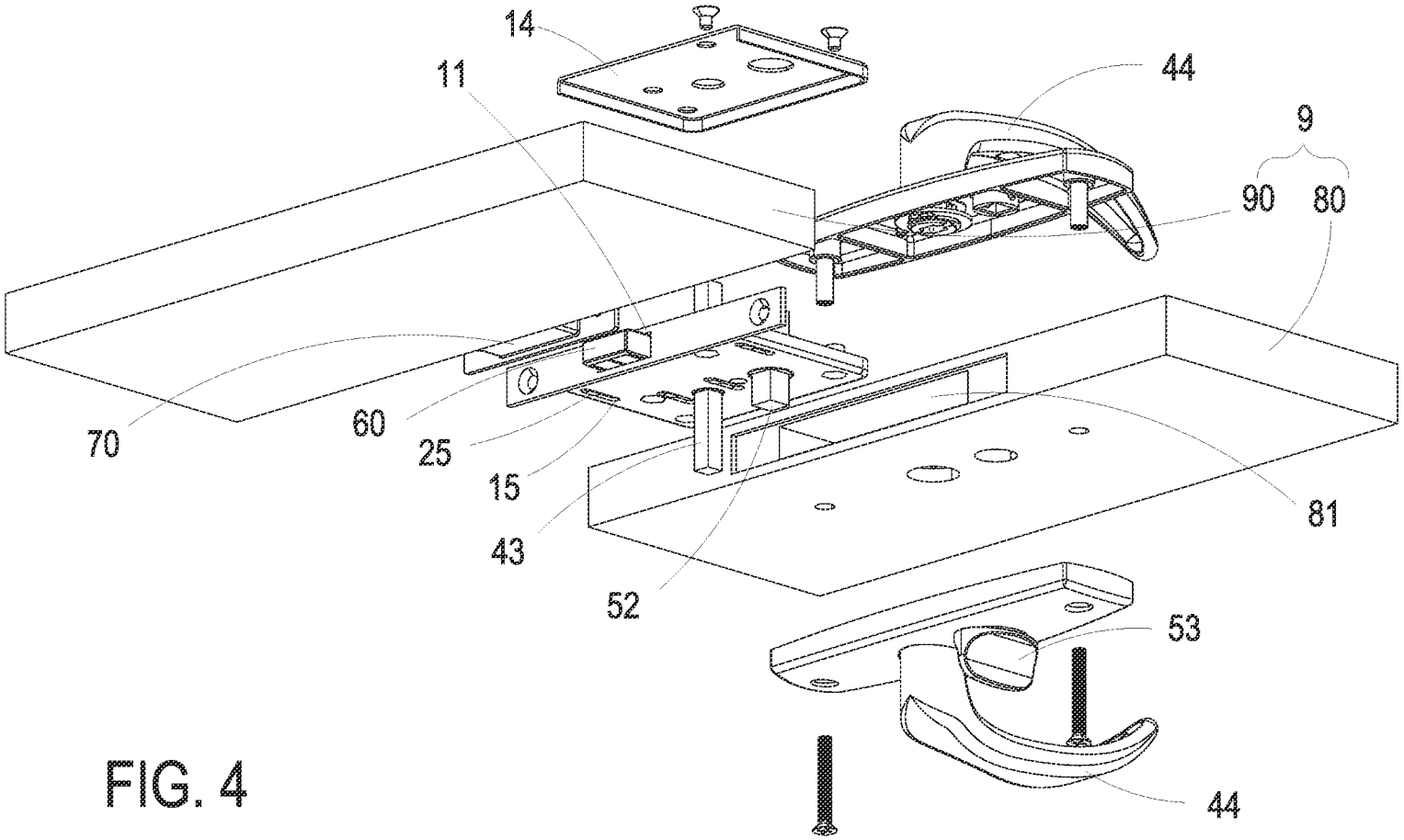
FIG. 4 is an exploded view illustrating the magnetic-actuation latch device disposed on the door body according to the embodiment of the present disclosure.

FIG. 1 is an exploded view illustrating a magnetic-actuation latch device according to an embodiment of the present disclosure. FIG. 2 is an exploded view illustrating the magnetic-actuation latch device according to the embodiment of the present disclosure and taken from another perspective. FIG. 3 is an exploded view illustrating the magnetic-actuation latch device disposed on a door body according to the embodiment of the present disclosure. FIG. 4 is an exploded view illustrating the magnetic-actuation latch device disposed on the door body according to the embodiment of the present disclosure. In the embodiment, the magnetic-actuation latch device 1 is disposed on for example but not limited to a door body 9. The door body 9 includes a movable component 80 and a fixed component 90. Preferably but not exclusively, the magnetic-actuation latch device 1 is applied to a door lock. The fixed component 90 is for example but not limited to a door frame. The movable component 80 is for example but not limited to a door panel. In the embodiment, the movable component 80 includes an installation slot 81. The magnetic-actuation latch device 1 spatially corresponds to the installation slot 81 and is fixed on the movable component 80. Moreover, in the embodiment, the fixed component 90 includes a first magnetic block 72.

In the embodiment, the magnetic-actuation latch device 1 includes a housing 10, a latch element 60, a sliding plate 20, at least one elastic component 30*a*, 30*b*, a rotating element 40 and a limitation element 50. Preferably but not exclusively, the housing 10 is a flat housing and configured to be embedded in the installation slot 81 of the movable component 80. In the embodiment, the housing 10 includes an accommodation seat 12 and a lateral opening 11. The lateral opening 11 is communication with the accommodation seat 12, and the lateral opening 11 spatially corresponds to the first magnetic block 72. Preferably but not exclusively, in an embodiment, the housing 10 further includes an upper cover 14. The present disclosure is not limited thereto.

In the embodiment, the latch element 60 is for example but not limited to a tongue structure. The latch element 60 spatially corresponds to the lateral opening 11 and includes a second magnetic block 63. In the embodiment, the latch element 60 further includes an accommodation slot 62 configured to accommodate the second magnetic block 63. Preferably but not exclusively, the accommodation slot 62 has an opening facing the sliding plate 20. Certainly, the present disclosure is not limited thereto. In the embodiment, when the second magnetic block 63 is aligned to the first magnetic block 72, an actuation force is generated to drive the latch element 60 to pass through the lateral opening 11, and the latch element 60 is exposed from the lateral opening 11 and engaged with the fixed component 90, so that the movable component 80 and the fixed component 90 of the door body 9 are operated in a closed state. Thereby, the function of automatic closing the door body 9 is achieved.

In the embodiment, the sliding plate 20 is received in the accommodation seat 12 of the housing 10 and connected to the latch element 60. The sliding plate 20 includes two connection ends 21*a*, 21*b*, a guiding slot 22 and a guiding portion 23. The guiding slot 22 spatially corresponds to the latch element 60 and the lateral opening 11. The guiding portion 23 is disposed adjacent to the guiding slot 22, and the guiding slot 22 is located between the two connection ends 21*a*, 21*b*. In the embodiment, the guiding slot 22 is configured to guide the sliding plate 20 to slide relative to the housing 10. Preferably but not exclusively, in the embodiment, the sliding plate 20 is slid against the bottom of the housing 10. The sliding plate 20 further includes at least one guiding pillar 25, and the housing 10 further includes at least one guiding groove 15. The guiding pillar 25 is received in the guiding groove 15 and configured to guide a sliding direction of the sliding plate 20 relative to the housing 10. Preferably but not exclusively, the extending direction of the guiding groove 15 is parallel to the extending direction of the guiding slot 22. Namely, the guiding slot 22 and the guiding groove 15 are parallel to each other. Certainly, the present disclosure is limited thereto.

In the embodiment, the latch element 60 and the sliding plate 20 are connected through a pair of collars 61*a*, 61*b*, and a pair of protrusions 24*a*, 24*b*, which are matched and engaged with each other, so as to achieve the connection therebetween. Certainly, the present disclosure is not limited thereto. Moreover, in the embodiment, the elastic components 30*a*, 30*b* are connected to the two connection ends 21*a*, 21*b* of the sliding plate 20 and the housing 10 and configured to provide an elastic force to drive the sliding plate 20 and the latch element 60 to move away from the lateral opening 11. In the embodiment, the actuation force generated by aligning the second magnetic block 63 to the first magnetic block 72 is greater than the elastic force generated by the elastic components 30*a*, 30*b*. In that, when the second magnetic block 63 and the first magnetic block 72 are aligned to each other, it is advantageous for the latch element 60 and the fixed component 90 to be engaged reliably. Moreover, it ensures that the moving component 80 and the fixed component 90 of the door body 9 are operated in the closed state.

Preferably but not exclusively, the elastic components 30*a*, 30*b* include two tension springs. In the embodiment, first ends of the two tension springs are connected to the two connection ends 21*a*, 21*b* of the sliding plate 20, respectively, and second ends of the two tension springs are connected to two connection pillars 13*a*, 13*b* of the housing 10, respectively. In the embodiment, the guiding slot 22 of the sliding plate 20 is located between the two tension springs of the elastic components 30*a*, 30*b*, so as to provide a stable elastic force acting on the sliding plate 20 and the latch element 60. In other embodiments, two connection ends 21*a*, 21*b* of the sliding plate 20 and the elastic components 30*a*, 30*b* are disposed symmetrically with the guiding slot 22 as the center. The present disclosure is not limited thereto.

In the embodiment, the rotating element 40 is pivotally connected to the housing 10 and located in the guiding slot 22 of the sliding plate 20. The rotating element 40 includes an abutting end 41 and a limited end 42 disposed on the periphery of the rotating element 40, respectively. When the rotating element 40 is rotated by an external force, the abutting end 41 is engaged with the guiding portion 23 of the sliding plate 20 to move the sliding plate 20. Consequently, a pushing force is generated to resist the actuation force generated by aligning the second magnetic block 63 to the first magnetic block 72, and the guiding slot 22 of the sliding plate 20 is driven to slide relative to the rotating element 40. The second magnetic block 63 of the latch element 60 is separated from the first magnetic block 72, so that the second magnetic block 63 and the first magnetic block 72 are misaligned to each other to eliminate the actuation force. At this time, the latch element 60 is driven by the sliding plate 20 to retract into the accommodation seat 12 of the housing 10 and free of passing through the lateral opening 11, thereby achieving the purpose of opening the door body 9. When the second magnetic block 63 and the first magnetic block 72 are misaligned, the elastic force generated by the elastic components 30*a*, 30*b* drives the sliding plate 20 and the latch element 40 to keep the latch element 40 free of passing through the lateral opening 11.

Moreover, in the embodiment, the limitation element 50 is pivotally connected to the housing 10 and includes a limitation portion 51 spatially corresponding to the limited end 42 of the rotating element 40. When the limitation portion 51 of the limitation element 50 is rotated to be aligned to and engaged with the limited end 42 of the rotating element 40, the rotating element 40 is blocked by the limitation element 50 and not rotatable. The function of locking is achieved. On the other hand, when the limitation portion 51 of the limitation element 50 is rotated to be separated from and misaligned to the limited end 42 of the rotating element 40, the rotation of the rotating element 40 is not blocked. It allows the rotating element 40 to be rotated by the external force, so as to drive the sliding plate 20 and the latch element 60 to slide. In that, the latch element 60 is free of passing through the lateral opening 11, and the purpose of opening the door body 9 is achieved.

In the embodiment, the magnetic-actuation latch device 1 further includes a stopper 70 disposed on a mounting slot 91 of the fixed component 90. The stopper 70 spatially corresponds to the latch element 60. In the embodiment, the first magnetic block 72 is embedded in an engaging slot 71 of the stopper 70. In that, when the second magnetic block 63 of the latch element 60 is aligned to the first magnetic block 72, the latch element 60 is driven to pass through the lateral opening 11 of the housing, the latch element 60 and the engaging slot 71 of the stopper 70 are engaged with each other, and the movable component 80 is restricted from moving relative to the fixed component 90, so that the movable component 80 and the fixed component 90 of the door body 9 are operated in a closed state. Thus, the function of closing the door body 9 automatically is achieved.

In the embodiment, the magnetic-actuation latch device 1 further includes an auxiliary elastic element 31 disposed between the rotating element 40 and the housing 10, and configured to provide a restoring force to rotate the abutting end 41 of the rotating element 40 to an initial position. Preferably but not exclusively, the auxiliary elastic element 31 is a torsion spring. In the embodiment, the housing 10 further includes a first limiting pillar 16 spatially corresponding to the abutting end 41 of the rotating element 40. When the rotating element 40 is subjected to the restoring force of the auxiliary elastic element 31, the first limiting pillar 16 is configured to restrict the abutting end 41 at the initial position. In the embodiment, the housing 10 further includes a second limiting pillar 17 spatially corresponding to the limitation portion 51 of the limitation element 50 and configured to restrict the limitation portion 51, so as to facilitate the limitation portion 51 of the limitation element 50 to align to and engage with the limited end 42 of the rotating element 40. The purpose of locking the door body 9 is achieved.

In the embodiment, the magnetic-actuation latch device 1 further includes a handle 44 and a first rotating shaft 43 passing through the rotating element 40 and at least partially exposed to the housing 10. The handle 44 covers the first rotating shaft 43, and is exposed from the movable component 80 and configured to be forced to rotate the rotating element 40. Moreover, in the embodiment, the magnetic-actuation latch device 1 further includes a locking knob 53 and a second rotating shaft 52 passing through the limitation element 50 and at least partially exposed to the housing 10. The locking knob 53 covers the second rotating shaft 52, and is exposed from the movable component 80 and configured to rotate the limitation element 50. It will be described later that the user operates the magnetic-actuation latch device 1 through the handle 44 and the locking knob 53 to open, close and lock the door body 9.

Figure 5:
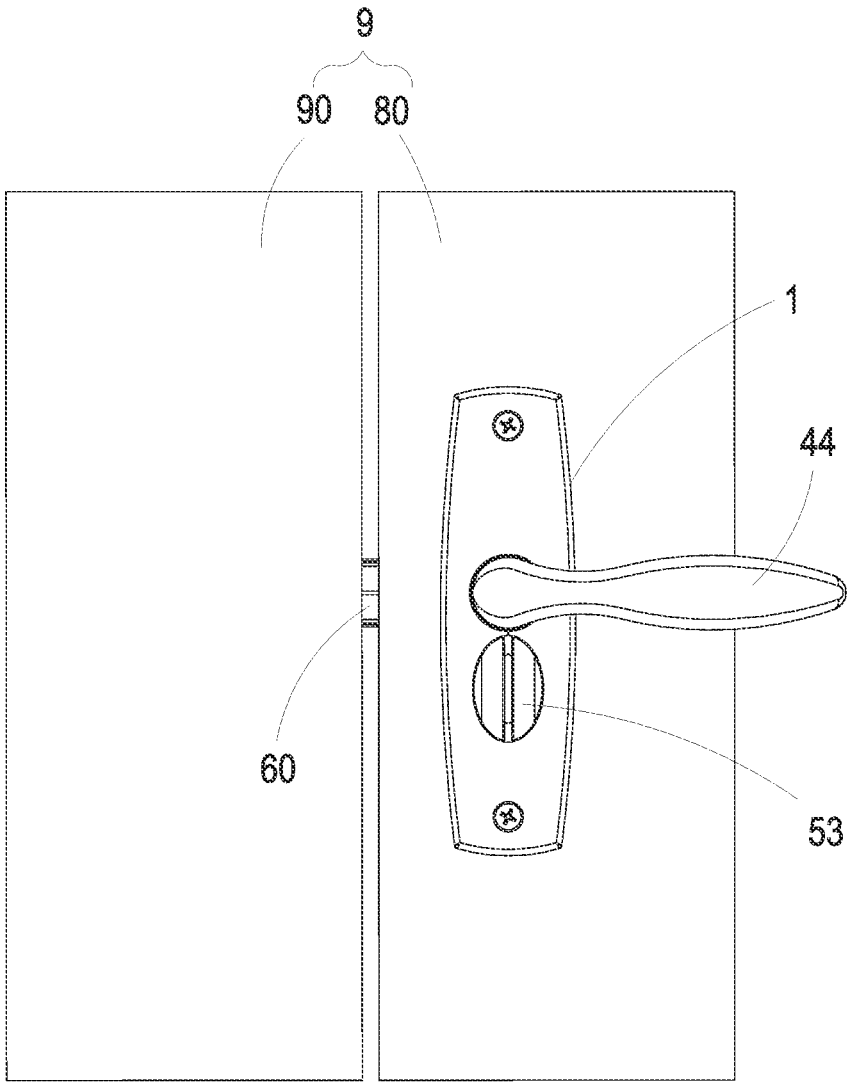
FIG. 5 is a schematic view showing the magnetic-actuation latch device operated the door body in a closed state.
Figure 6:
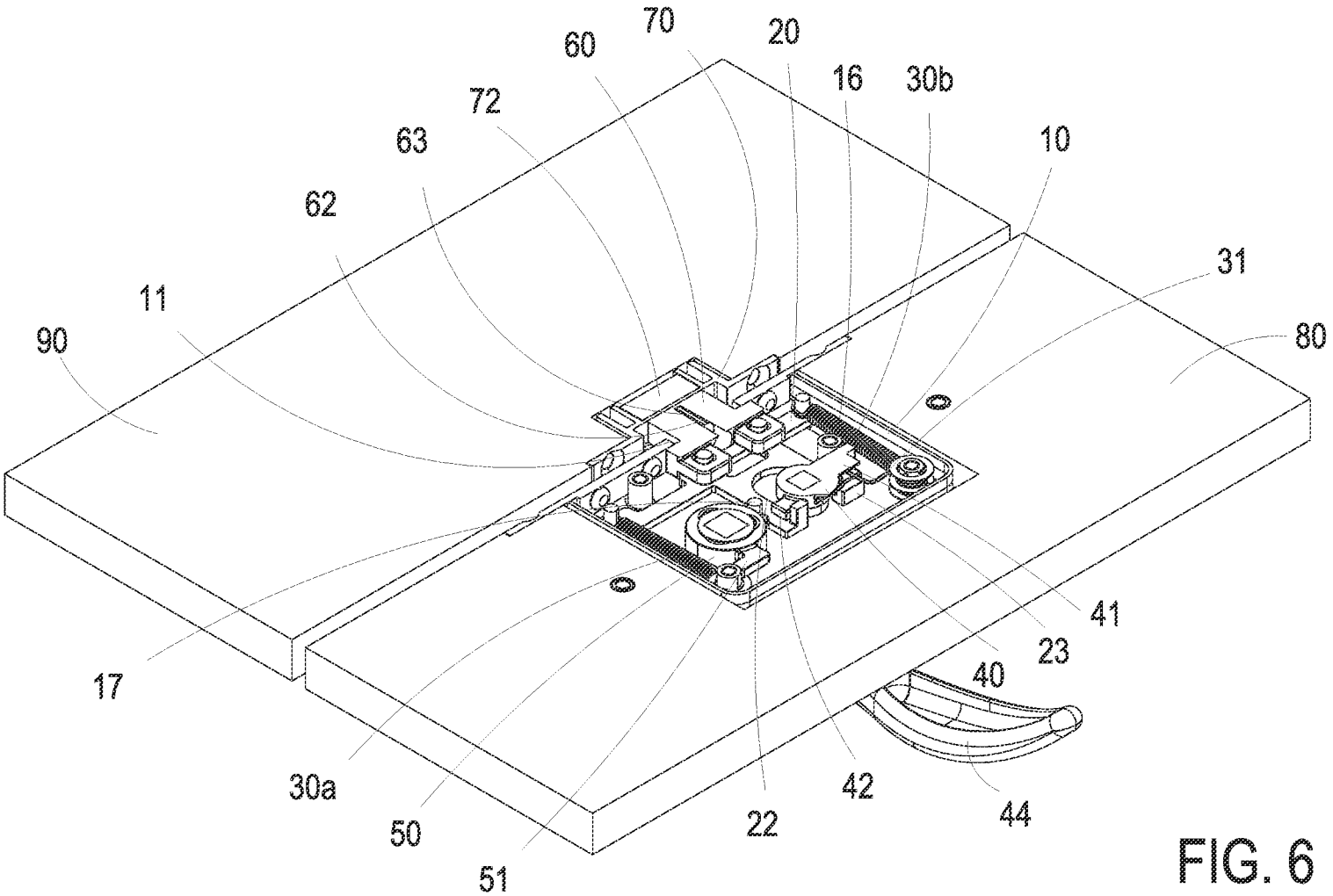
FIG. 6 is a cross-sectional structure of FIG. 5.
Figure 7:
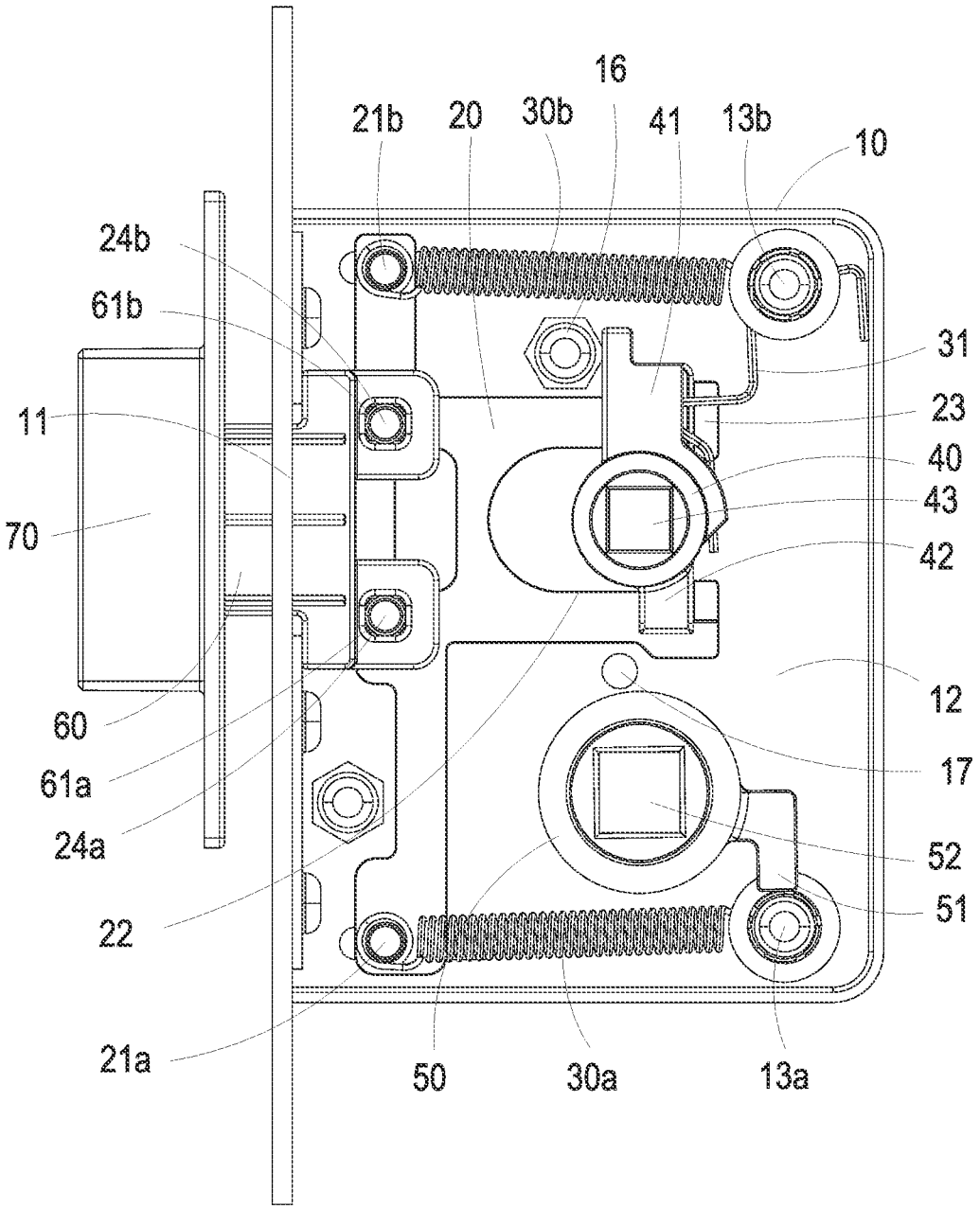
FIG. 7 is a schematic view showing the internal structure of the magnetic-actuation latch device of FIG. 5.
Figure 8:
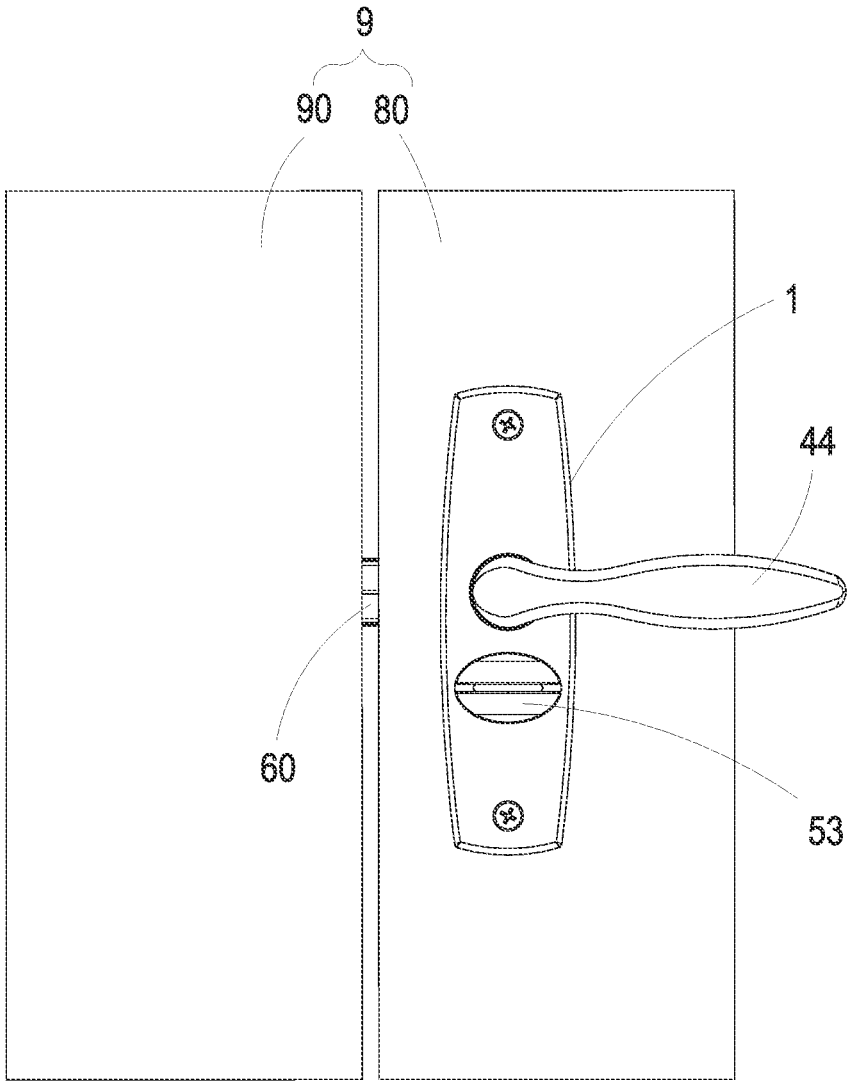
FIG. 8 is a schematic view showing the magnetic-actuation latch device operated the door body in a locked state.
Figure 9:
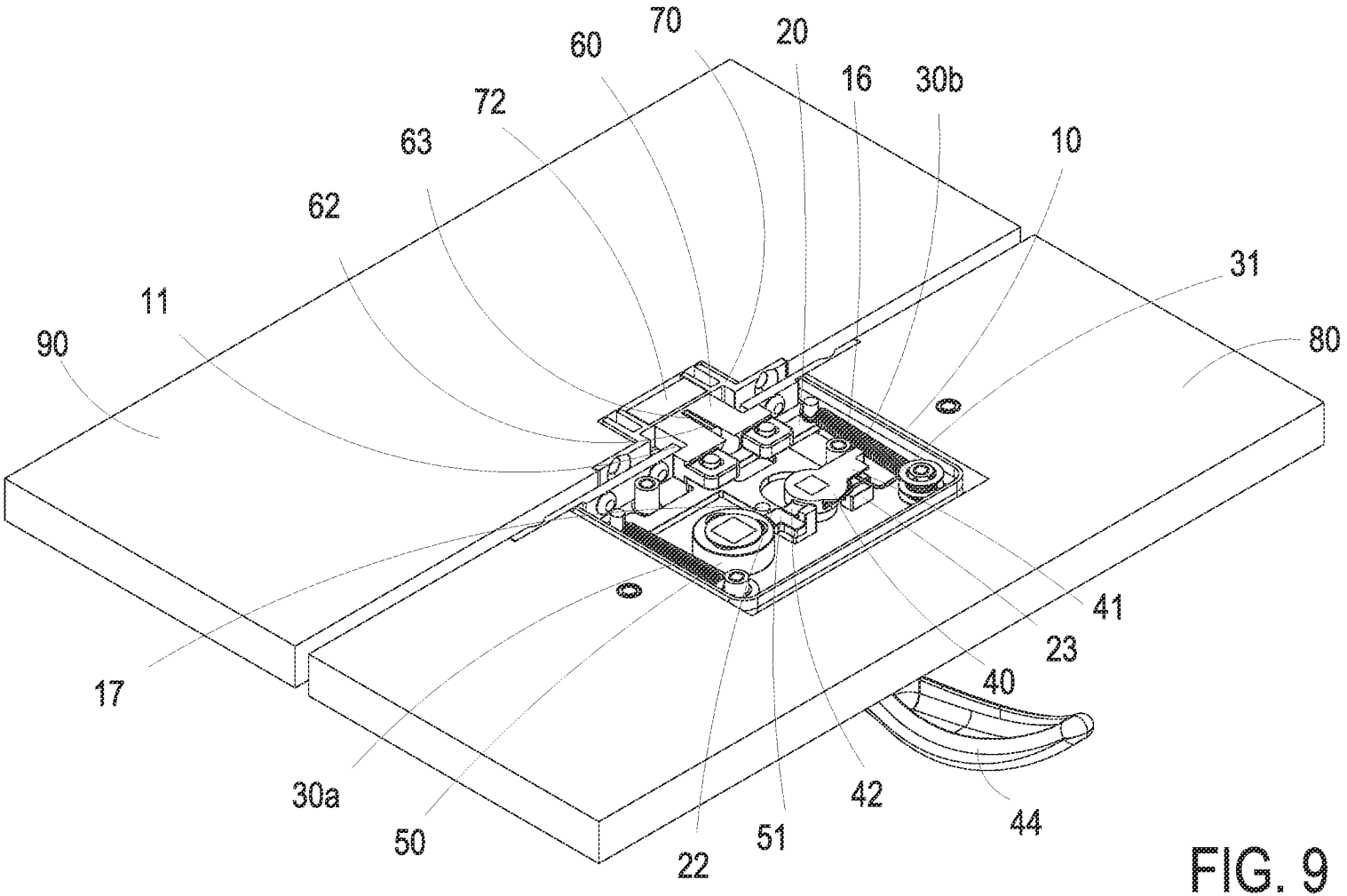
FIG. 9 is a cross-sectional structure of FIG. 8.
Figure 10:
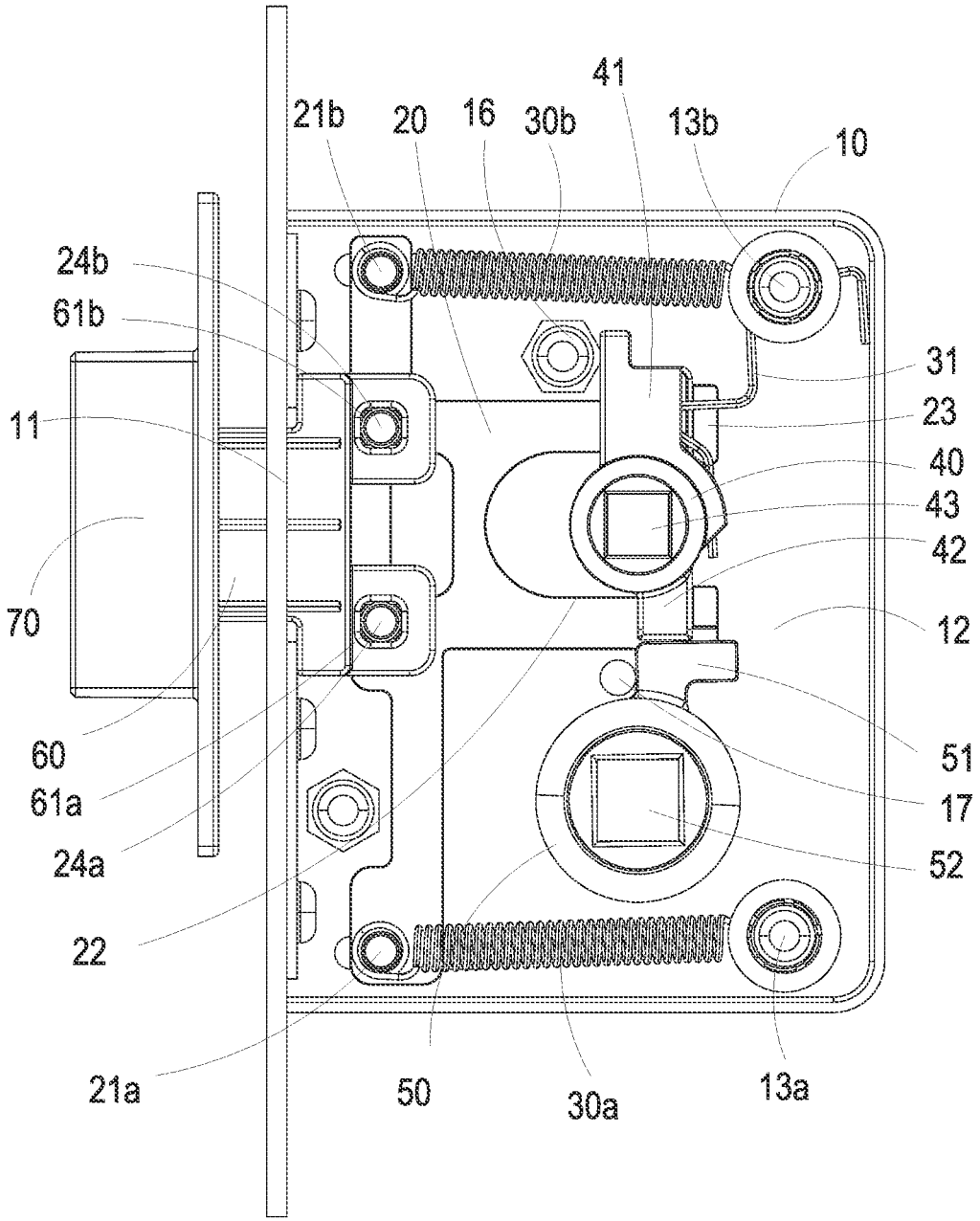
FIG. 10 is a schematic view showing the internal structure of the magnetic-actuation latch device of FIG. 8.
Figure 11:
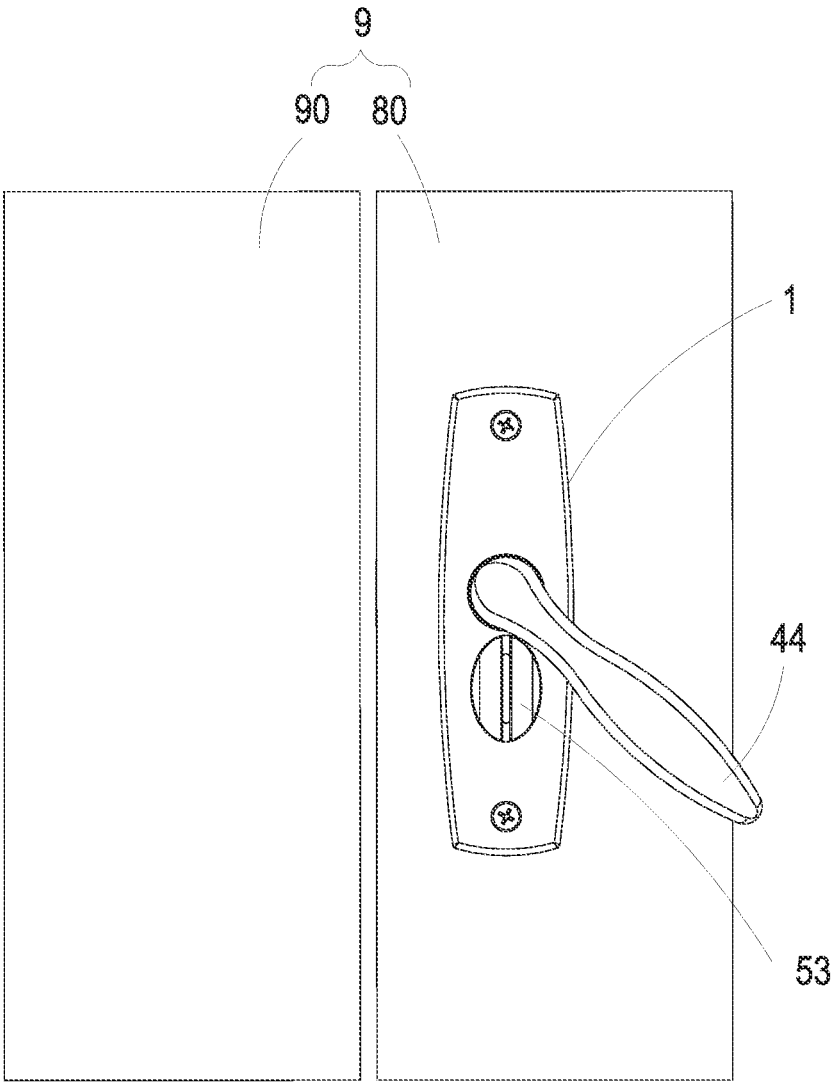
FIG. 11 is a schematic view showing the magnetic-actuation latch device operated the door body in an open state.
Figure 12:
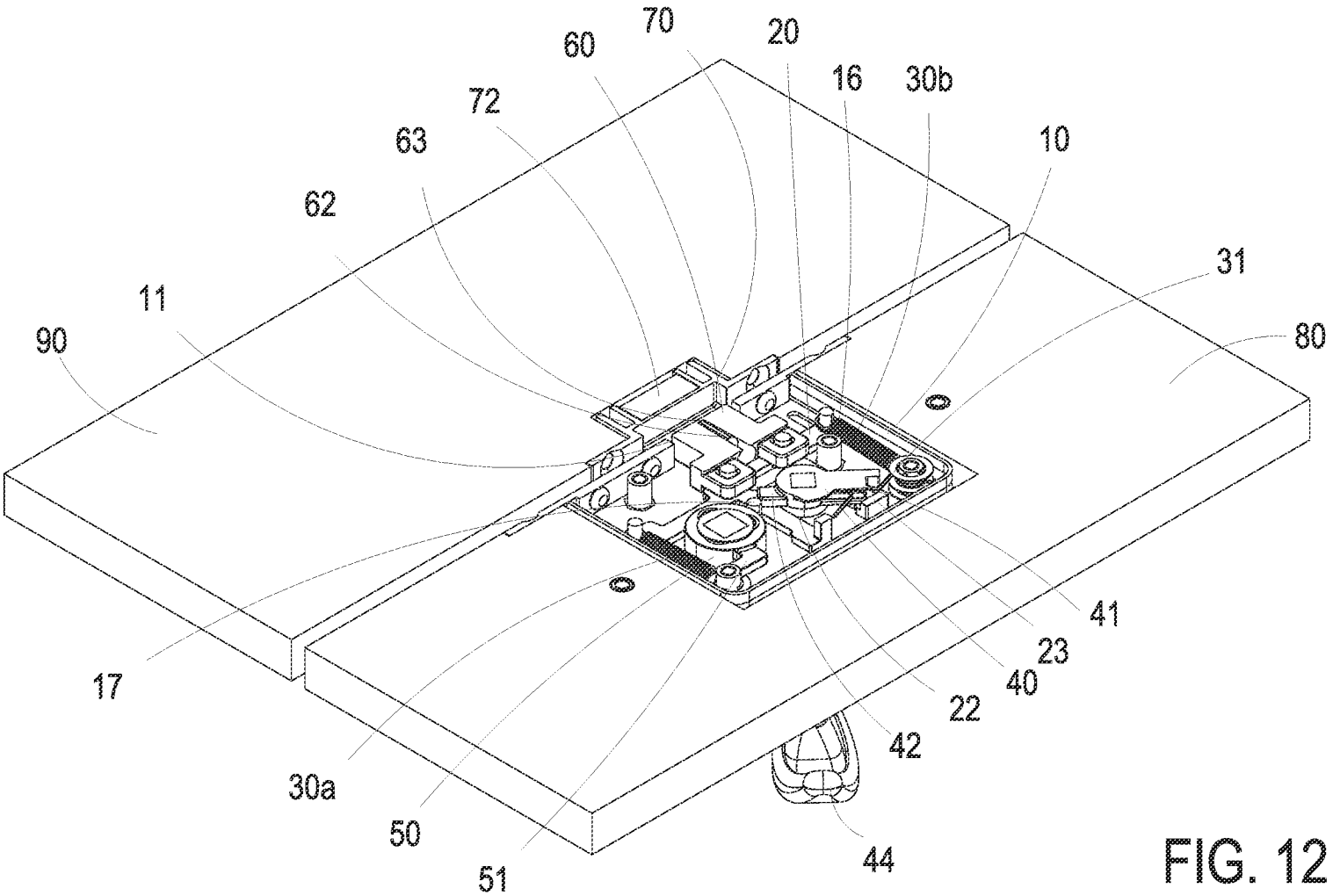
FIG. 12 is a cross-sectional structure of FIG. 11.
Figure 13:
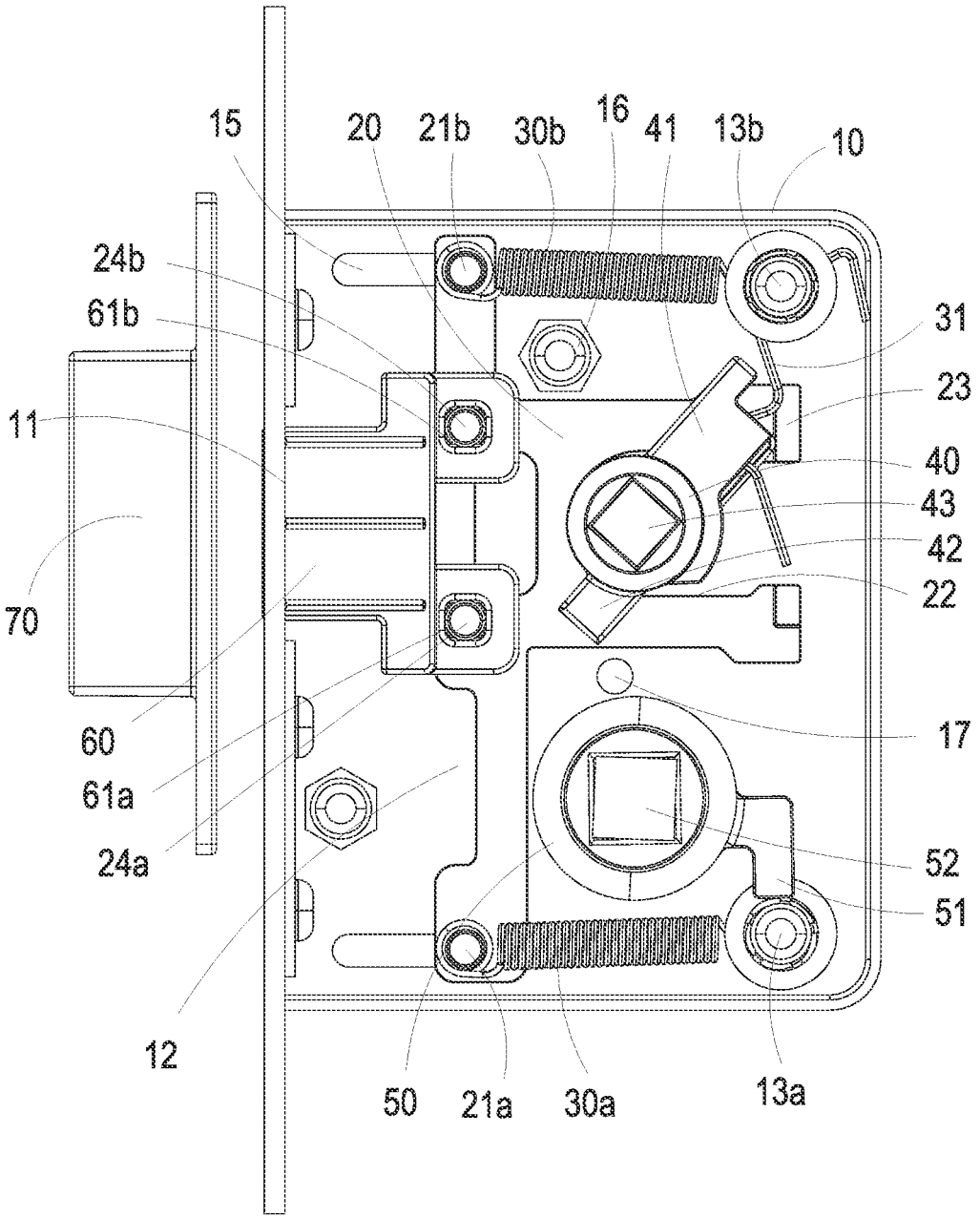
FIG. 13 is a schematic view showing the internal structure of the magnetic-actuation latch device of FIG. 11.

FIG. 5 is a schematic view showing the magnetic-actuation latch device operated the door body in a closed state. FIG. 6 is a cross-sectional structure of FIG. 5. FIG. 7 is a schematic view showing the internal structure of the magnetic-actuation latch device of FIG. 5. FIG. 8 is a schematic view showing the magnetic-actuation latch device operated the door body in a locked state. FIG. 9 is a cross-sectional structure of FIG. 8. FIG. 10 is a schematic view showing the internal structure of the magnetic-actuation latch device of FIG. 8. FIG. 11 is a schematic view showing the magnetic-actuation latch device operated the door body in an open state. FIG. 12 is a cross-sectional structure of FIG. 11. FIG. 13 is a schematic view showing the internal structure of the magnetic-actuation latch device of FIG. 11. When the magnetic-actuation latch device 1 of the present disclosure is applied to the door body 9, the functions of automatic aligning-and-closing, locking and opening are achieved. Firstly, as shown in FIGS. 5 to 7, the movable component 80 such as the door panel is rotated relative to the fixed component 90 such as the door frame to align the second magnetic block 63 of the latch element 60 to the first magnetic block 72 on the fixed component 90. As the first magnetic block 72 and the second magnetic block 63 are attracted to each other by the magnetic force, an actuation force is generated against the elastic force of the elastic components 30*a*, 30*b*, so that the latch element 60 and the sliding plate 20 are moved toward the stopper 70 on the fixed component 90. The latch element 60 passes through the lateral opening 11 of the housing 10 and is partially received in the engaging slot 71 of the stopper 70. By the engagement of the latch element 60 and the engaging slot 71 of the stopper 70, the movable component 80 is restricted from moving relative to the fixed component 90, so that the movable component 80 and the fixed component 90 of the door body 9 are operated in the closed state and the function of automatically closing the door body 9 is achieved. The user does not need to operate the handle 44. In this state, the handle 44 is not subject to an external force, and the abutting end 41 of the rotating element 40 is maintained at the initial position by the restoring force, provided by the auxiliary elastic element 31. Namely, the abutting end 41 of the rotating element 40 is restricted by the first limiting pillar 16 at the initial position. At this time, the limitation portion 51 of the limitation element 50 and the limited end 42 of the rotating element 40 are misaligned and separated from each other. The rotation of the rotating element 40 is not restricted and rotatable. It allows the user to operate the handle 44 to make the movable component 80 and the fixed component in the open state or the closed state for further opening and closing the door body 9.

Furthermore, as shown in FIGS. 8 to 10, when the user operates the locking knob 53 to rotate the limitation element 50, the limitation portion 51 of the limitation element 50 abuts against the second limiting pillar 17. Moreover, the limitation portion 51 of the limitation element 50 and the limited end 42 of the rotating element 40 are aligned to and engaged with each other. In that, the rotation of the rotating element 40 is restricted by the limitation element 50, and the user cannot turn the handle 44 for operation. The door body 9 is maintained in the closed state, the purpose of locking the door body 9 is achieved. To release the locking of the door body 9, the user can operate the locking knob 53 to rotate in the reverse direction, so that the limitation portion 51 of the limitation element 50 and the limited end 42 of the rotating element 40 are misaligned and separated from each other. At this time, the rotation of the rotating member 40 is not restricted. That is, as shown in FIGS. 5 to 7, the rotating element 40 is rotatable through an external force, so as to drive the sliding plate 20 and the latch element 60 to slide.

On the other hand, when the limitation portion 51 of the limitation element 50 and the limited end 42 of the rotating element 40 are misaligned and separated from each other, the rotation of the rotating member 40 is not restricted, and the magnetic-actuation latch device 1 makes the door body 9 maintained in the closed state, as shown in FIGS. 5 to 7. The user can operate the handle 44 for further opening the door body 9. Please refer to FIGS. 11 to 13. When the rotation of the rotating element 40 is not restricted and the user operates the handle 44 to rotate, the rotating element 40 is rotated by the external force through the first rotating shaft 43, and the abutting end 41 of the rotating element 40 and the guiding portion 23 of the sliding plate 20 are engaged with each other and displaced. A pushing force is generated to resist the actuation force generated by the alignment of the second magnetic block 63 and the first magnetic block 72, and the guiding slot 22 of the sliding plate 20 is driven to slide relative to the rotating element 40 at the same time. Then, the second magnetic block 63 of the latch element 60 is separated from the first magnetic block 72. Since the second magnetic block 63 of the latch element 60 is misaligned and separated from the first magnetic block 72 on the fixed component 90, the latch element 60 is retracted into the accommodation seat 12 of the housing 10 without passing through the lateral opening 11, and the movable component 80 of the door body 9 is moved relative to the fixed component 90. When the movable component 80 is moved relative to the fixed component 90, the second magnetic block 63 and the first magnetic block 72 are misaligned to eliminate the actuation force. The sliding plate 20 is forced by the elastic force of the elastic components 30*a*, 30*b* to drive the sliding plate 20 and the latch element 60 to move away from the lateral opening 11, so that the latch element 60 is not exposed out of the lateral opening 11 of the housing 10. At this time, if the user releases the handle 44, the rotating element 40 is forced by the restoring force of the auxiliary elastic element 31, the abutting end 41 of the rotating element 40 is rotated. The abutting end 41 of the rotating element 40 is restricted by the first limiting pillar 16 and maintained at the initial position. In addition, when the movable component 80 of the door body 9 is moved relative to the fixed component 90, and the second magnetic block 63 and the first magnetic block 72 are aligned to each other, the first magnetic block 72 and the second magnetic block 63 are attracted by the magnetic force to generate an actuation force. The actuation force resists the elastic force of the elastic components 30*a*, 30*b*, so that the latch element 60 and the sliding plate 20 are moved toward the stopper 70 on the fixed component 90. The latch element 60 passes through the lateral opening 11 of the housing 10 and is partially received in the engaging slot 71 of the stopper 70. The function of automatically closing the door body 9 is achieved.

In summary, the present disclosure provides a magnetic-actuation latch device applied to a door lock or a drawer lock. With the components arranged in a flat housing, it facilitates the magnetic-actuation latch device to be embedded in the applied door body and meets the requirement of thinning. Moreover, by utilizing the actuation force between the magnetic blocks of the magnetic-actuation latch device, it is helpful for achieving the purpose of closing the door automatically. The entire structure of the magnetic-actuation latch device is compact. The overall structure is compact. It is easy to assemble, maintain and operate. In addition, the magnetic-actuation latch device has a compacted-and-thinned structure, and can be assembled easily. The sliding plate is controlled to slide relative to the housing by the guiding slot disposed in the center and the elastic component connected on both sides. In addition to meeting the requirements of thinned design, it is also conducive to improving the sliding stability of the sliding plate relative to the housing. Furthermore, a guiding pillar and a guiding groove are disposed correspondingly between the sliding plate and the housing. It is helpful for enhancing the sliding stability of the sliding plate relative to the housing. Moreover, compared with the conventional tenon structure, the magnetic-actuation latch device further provides the functions of automatically aligning and closing the door body by utilizing the actuation force between the magnetic blocks. Combined with the thinned design, the components of the magnetic-actuation latch device are arranged in a flat housing. It is easier to assemble, replace or maintain. The competitiveness of the magnetic-actuation latch device is improved effectively.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A magnetic-actuation latch device for being disposed on a door body, wherein the door body comprises a movable component and a fixed component, the movable component comprises an installation slot, the fixed component comprises a first magnetic block, and the magnetic-actuation latch device comprises:

a housing configured to be embedded in the installation slot of the movable component, wherein the housing comprises an accommodation seat and a lateral opening, the lateral opening is communication with the accommodation seat, and the and the lateral opening spatially corresponds to the first magnetic block;

a latch element spatially corresponding to the lateral opening and comprising a second magnetic block, wherein when the second magnetic block is aligned to the first magnetic block, an actuation force is generated to drive the latch element to pass through the lateral opening, and the latch element is exposed from the lateral opening and engaged with the fixed component, so that the movable component and the fixed component of the door body are closed;

a sliding plate received in the accommodation seat and connected to the latch element, wherein the sliding plate comprises two connection ends, a guiding slot and a guiding portion, the guiding slot spatially corresponds to the latch element and the lateral opening, the guiding portion is disposed adjacent to the guiding slot, and the guiding slot is located between the two connection ends;

at least one elastic component connected to the two connection ends of the sliding plate and the housing and configured to provide an elastic force to drive the sliding plate and the latch element to move away from the lateral opening;

a rotating element pivotally connected to the housing and located in the guiding slot of the sliding plate, wherein the rotating element comprises a abutting end and a limited end disposed on the periphery of the rotating element, respectively, wherein when the rotating element is rotated by an external force, the abutting end is engaged with the guiding portion to resist the actuation force and drives the guiding slot of the sliding plate to slide relative to the rotating element, the second magnetic block of the latch element is separated from the first magnetic block, and the latch element is free of passing through the lateral opening, wherein when the second magnetic block and the first magnetic block are misaligned, the elastic force drives the sliding plate and the latch element to keep the latch element free of passing through the lateral opening; and a limitation element pivotally connected to the housing and comprising a limitation portion spatially corresponding to the limited end of the rotating element, wherein when the limitation portion of the limitation element is rotated to be aligned to and engaged with the limited end, the rotating element is blocked.

2. The magnetic-actuation latch device according to claim 1, wherein when the limitation portion of the limitation element is rotated to be misaligned to and separated from the limited end, the rotating element is rotatable.

3. The magnetic-actuation latch device according to claim 1, further comprising a stopper disposed on a mounting slot of the fixed component and spatially corresponding to the latch element.

4. The magnetic-actuation latch device according to claim 3, wherein the first magnetic block is embedded in an engaging slot of the stopper, wherein when the second magnetic block is aligned to the first magnetic block, the latch element is driven to pass through the lateral opening, the latch element and the engaging slot of the stopper are engaged with each other, and the movable component is restricted from moving relative to the fixed component, so that the movable component and the fixed component of the door body are closed.

5. The magnetic-actuation latch device according to claim 1, further comprising an auxiliary elastic element disposed between the rotating element and the housing, and configured to provide a restoring force to rotate the abutting end to an initial position.

6. The magnetic-actuation latch device according to claim 5, wherein the auxiliary elastic element is a torsion spring.

7. The magnetic-actuation latch device according to claim 5, wherein the housing comprises a first limiting pillar spatially corresponding to the abutting end of the rotating element, wherein when the rotating element is subjected to the restoring force of the auxiliary elastic element, the first limiting pillar is configured to restrict the abutting end at the initial position.

8. The magnetic-actuation latch device according to claim 1, wherein the housing comprises a second limiting pillar spatially corresponding to the limitation portion of the limitation element and configured to restrict the limitation portion, so as to facilitate the limitation portion to align to and engage with the limited end.

9. The magnetic-actuation latch device according to claim 1, wherein the sliding plate comprises at least one guiding pillar, and the housing comprises at least one guiding groove, wherein the guiding pillar is received in the guiding groove and configured to guide a sliding direction of the sliding plate relative to the housing.

10. The magnetic-actuation latch device according to claim 1, wherein the guiding slot and the guiding groove are parallel to each other.

11. The magnetic-actuation latch device according to claim 1, further comprising a handle and a first rotating shaft passing through the rotating element and at least partially exposed to the housing, wherein the handle covers the first rotating shaft, and is exposed from the movable component and configured to be forced to rotate the rotating element.

12. The magnetic-actuation latch device according to claim 1, further comprising a locking knob and a second rotating shaft passing through the limitation element and at least partially exposed to the housing, wherein the locking knob covers the second rotating shaft, and is exposed from the movable component and configured to rotate the limitation element.

13. The magnetic-actuation latch device according to claim 1, wherein the at least one elastic component comprises two elastic components.

14. The magnetic-actuation latch device according to claim 13, wherein the two elastic components are two tension springs, wherein first ends of the two tension springs are connected to the two connection ends of the sliding plate, respectively, and second ends of the two tension springs are connected to the housing, respectively, wherein the guiding slot of the sliding plate is located between the two tension springs.

15. The magnetic-actuation latch device according to claim 13, wherein two connection ends of the sliding plate and the two elastic components are disposed symmetrically with the guiding slot as the center.

16. The magnetic-actuation latch device according to claim 1, wherein the latch element and the sliding plate are connected through a pair of collars and a pair of protrusions matched and engaged with each other.

17. The magnetic-actuation latch device according to claim 1, wherein the latch element comprises an accommodation slot configured to accommodate the second magnetic block.

18. The magnetic-actuation latch device according to claim 17, wherein the accommodation slot has an opening facing the sliding plate.

19. The magnetic-actuation latch device according to claim 1, wherein the housing comprises an upper cover.

20. The magnetic-actuation latch device according to claim 1, wherein the actuation force is greater than the elastic force.

* * * * *